US010689962B2

(12) United States Patent
Morrow et al.

(10) Patent No.: US 10,689,962 B2
(45) Date of Patent: Jun. 23, 2020

(54) REMOTELY ACTUATED SCREENOUT RELIEF VALVES AND SYSTEMS AND METHODS INCLUDING THE SAME

(71) Applicants: Timothy I. Morrow, Humble, TX (US); Randy C. Tolman, Spring, TX (US); Renzo M. Angeles Boza, Houston, TX (US); Mark M. Disko, Glen Gardner, NJ (US); Max Deffenbaugh, Fulshear, TX (US)

(72) Inventors: Timothy I. Morrow, Humble, TX (US); Randy C. Tolman, Spring, TX (US); Renzo M. Angeles Boza, Houston, TX (US); Mark M. Disko, Glen Gardner, NJ (US); Max Deffenbaugh, Fulshear, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 92 days.

(21) Appl. No.: 16/159,193

(22) Filed: Oct. 12, 2018

(65) Prior Publication Data

US 2019/0128106 A1 May 2, 2019

Related U.S. Application Data

(62) Division of application No. 15/059,739, filed as application No. PCT/US2013/076270 on Dec. 18, 2013, now Pat. No. 10,132,149.

(Continued)

(51) Int. Cl.

*E21B 43/267* (2006.01)
*E21B 43/04* (2006.01)

(Continued)

(52) U.S. Cl.

CPC ..... *E21B 43/267* (2013.01); *E21B 34/06* (2013.01); *E21B 34/066* (2013.01); *E21B 34/10* (2013.01);

(Continued)

(58) Field of Classification Search

CPC ..... E21B 43/04; E21B 43/26; E21B 43/267; E21B 43/14; E21B 21/103; E21B 34/06; E21B 34/08; E21B 43/25

See application file for complete search history.

(56) References Cited

U.S. PATENT DOCUMENTS 4,314,365 A 2/1982 Peterson et al. ..... 367/82
4,884,071 A 1/1989 Howard ..... 340/854

(Continued)

FOREIGN PATENT DOCUMENTS

EP 0636763 1/1995 ..... E21B 47/12
EP 1409839 6/2005 ..... E21B 43/1185

(Continued)

OTHER PUBLICATIONS

Emerson Process Management (2011) "Roxar Downhole Wireless PT Sensor System," www.roxar.com or downhole@roxar.com, 2 pages.

*Primary Examiner* — Kipp C Wallace
(74) *Attorney, Agent, or Firm* — ExxonMobil Upstream Research Company—Law Department

(57) ABSTRACT

Remotely actuated screenout relief valves, systems and methods are disclosed herein. The methods include providing a proppant slurry stream that includes proppant to a casing conduit that is defined by a casing string that extends within a subterranean formation. The methods further include detecting an operational parameter that is indicative of a screenout event within the casing conduit. Responsive to the detecting, the methods include providing a flush fluid (Continued)

stream to the casing conduit, opening the remotely actuated screenout relief valve, and displacing the proppant from the casing conduit into the subterranean formation with the flush fluid stream via the remotely actuated screenout relief valve. The methods may further include closing the remotely actuated screenout relief valve. The systems include hydrocarbon wells that include the remotely actuated screenout relief valve and/or hydrocarbon wells that include controllers that are configured to perform at least a portion of the methods.

20 Claims, 4 Drawing Sheets

Related U.S. Application Data

(60) Provisional application No. 61/909,161, filed on Nov. 26, 2013.

(51) Int. Cl.

| | |
|---|---|
| ***E21B 34/06*** | (2006.01) |
| ***E21B 43/26*** | (2006.01) |
| ***E21B 34/10*** | (2006.01) |
| ***E21B 47/06*** | (2012.01) |
| *E21B 43/11* | (2006.01) |

(52) U.S. Cl.

CPC ..... *E21B 43/26* (2013.01); *E21B 43/261* (2013.01); *E21B 47/06* (2013.01); *E21B 43/11* (2013.01)

(56) References Cited

U.S. PATENT DOCUMENTS

| | | | | |
|---|---|---|---|---|
| 5,128,901 | A | 7/1992 | Drumheller | 367/82 |
| 5,234,055 | A | 8/1993 | Cornette | 166/278 |
| 5,480,201 | A | 1/1996 | Mercer | 294/67.31 |
| 5,495,230 | A | 2/1996 | Lian | 340/551 |
| 5,562,240 | A | 10/1996 | Campbell | 227/130 |
| 5,592,438 | A | 1/1997 | Rorden et al. | 367/83 |
| 5,850,369 | A | 12/1998 | Rorden et al. | 367/83 |
| 5,924,499 | A | 7/1999 | Birchak et al. | 175/40 |
| 5,995,449 | A | 11/1999 | Green et al. | 367/83 |
| 6,049,508 | A | 4/2000 | Deflandre | 367/38 |
| 6,429,784 | B1 | 8/2002 | Beique et al. | 340/853.7 |
| 6,462,672 | B1 | 10/2002 | Besson | 340/853.2 |
| 6,491,098 | B1 * | 12/2002 | Dallas | E21B 43/116 166/297 |
| 6,670,880 | B1 | 12/2003 | Hall et al. | 336/132 |
| 6,695,277 | B1 | 2/2004 | Gallis | 249/197 |
| 6,717,501 | B2 | 4/2004 | Hall et al. | 336/132 |
| 6,816,082 | B1 | 11/2004 | Laborde | 340/853.3 |
| 6,868,037 | B2 | 3/2005 | Dasgupta et al. | 367/54 |
| 6,899,178 | B2 | 5/2005 | Tubel | 166/313 |
| 6,912,177 | B2 | 6/2005 | Smith | 367/82 |
| 6,956,791 | B2 | 10/2005 | Dopf et al. | 367/81 |
| 6,980,929 | B2 | 12/2005 | Aronstam et al. | 702/188 |
| 6,987,463 | B2 | 1/2006 | Beique et al. | 340/856.3 |
| 7,006,918 | B2 | 2/2006 | Economides et al. | 702/1 |
| 7,064,676 | B2 | 6/2006 | Hall et al. | 340/853.1 |
| 7,082,993 | B2 | 8/2006 | Ayoub et al. | 166/254.2 |
| 7,140,434 | B2 | 11/2006 | Chouzenoux et al. | 166/250.11 |
| 7,224,288 | B2 | 5/2007 | Hall et al. | 340/853.7 |
| 7,249,636 | B2 | 7/2007 | Ohmer | 166/378 |
| 7,257,050 | B2 | 8/2007 | Stewart et al. | 367/82 |
| 7,277,026 | B2 | 10/2007 | Hall et al. | 340/854.8 |
| 7,317,990 | B2 | 1/2008 | Sinha et al. | 702/6 |
| 7,348,893 | B2 | 3/2008 | Huang et al. | 340/854.3 |
| 7,411,517 | B2 | 8/2008 | Flanagan | 340/854.4 |
| 7,477,160 | B2 | 1/2009 | Lemenager et al. | 340/853.1 |
| 7,516,792 | B2 | 4/2009 | Lonnes et al. | 166/297 |
| 7,595,737 | B2 | 9/2009 | Fink et al. | 340/854.4 |
| 7,602,668 | B2 | 10/2009 | Liang et al. | 367/83 |
| 7,649,473 | B2 | 1/2010 | Johnson et al. | 370/400 |
| 7,775,279 | B2 | 8/2010 | Marya et al. | 166/297 |
| 8,044,821 | B2 | 10/2011 | Mehta | 340/855.7 |
| 8,049,506 | B2 | 11/2011 | Lazarev | 324/333 |
| 8,115,651 | B2 | 2/2012 | Camwell et al. | 340/853.2 |
| 8,162,050 | B2 | 4/2012 | Roddy et al. | 166/253.1 |
| 8,220,542 | B2 | 7/2012 | Whitsitt et al. | 166/278 |
| 8,237,585 | B2 | 8/2012 | Zimmerman | 340/854.6 |
| 8,242,928 | B2 | 8/2012 | Prammer | 340/853.7 |
| 8,330,617 | B2 | 12/2012 | Chen et al. | 340/854.6 |
| 8,347,982 | B2 | 1/2013 | Hannegan et al. | 175/5 |
| 8,381,822 | B2 | 2/2013 | Hales et al. | 166/377 |
| 8,434,354 | B2 | 5/2013 | Crow et al. | 73/152.04 |
| 8,496,055 | B2 | 7/2013 | Mootoo et al. | 166/278 |
| 8,539,890 | B2 | 9/2013 | Tripp et al. | 109/25 |
| 8,544,564 | B2 | 10/2013 | Moore et al. | 175/50 |
| 8,826,980 | B2 | 9/2014 | Neer | 166/255.1 |
| 8,833,469 | B2 | 9/2014 | Purkis | 166/373 |
| 2002/0026958 | A1 | 3/2002 | Brisco | 137/268 |
| 2002/0043369 | A1 | 4/2002 | Vinegar et al. | 166/250.07 |
| 2003/0056953 | A1 | 3/2003 | Tumlin et al. | 166/298 |
| 2003/0075324 | A1 | 4/2003 | Dusterhoft et al. | 166/279 |
| 2003/0075325 | A1 | 4/2003 | Dusterhoft et al. | 166/279 |
| 2004/0065443 | A1 | 4/2004 | Berg et al. | 166/380 |
| 2004/0073370 | A1 | 4/2004 | Dasgupta et al. | 702/6 |
| 2004/0084187 | A1 | 5/2004 | Costley et al. | 166/312 |
| 2004/0084190 | A1 | 5/2004 | Hill et al. | 166/386 |
| 2004/0105342 | A1 | 6/2004 | Gardner et al. | 367/25 |
| 2004/0163811 | A1 | 8/2004 | McKee et al. | 166/279 |
| 2004/0256113 | A1 | 12/2004 | LoGiudice et al. | 166/381 |
| 2005/0024231 | A1 | 2/2005 | Fincher et al. | 340/854.4 |
| 2005/0039912 | A1 | 2/2005 | Hall et al. | 166/242.6 |
| 2005/0145010 | A1 | 7/2005 | Vanderveen et al. | 73/1.57 |
| 2005/0284659 | A1 | 12/2005 | Hall et al. | 172/27 |
| 2006/0002232 | A1 | 1/2006 | Shah et al. | 367/82 |
| 2006/0115095 | A1 | 6/2006 | Giesbrecht et al. | 381/66 |
| 2006/0124310 | A1 | 6/2006 | Lopez de Cardenas et al. | 166/313 |
| 2006/0133203 | A1 | 6/2006 | James et al. | 367/27 |
| 2007/0024464 | A1 | 2/2007 | Lemenager et al. | 340/853.1 |
| 2007/0029112 | A1 | 2/2007 | Li et al. | 175/26 |
| 2007/0030762 | A1 | 2/2007 | Huang et al. | 367/83 |
| 2007/0139217 | A1 | 6/2007 | Beique et al. | 340/856.3 |
| 2009/0045974 | A1 | 2/2009 | Patel | 340/854.6 |
| 2009/0159272 | A1 | 6/2009 | Auzerais et al. | 166/250.01 |
| 2009/0218094 | A1 | 9/2009 | McLeod et al. | 166/250.1 |
| 2009/0264956 | A1 | 10/2009 | Rise et al. | 607/45 |
| 2009/0277688 | A1 | 11/2009 | Oothoudt | 175/57 |
| 2009/0289808 | A1 | 11/2009 | Prammer | 340/853.7 |
| 2010/0013663 | A1 | 1/2010 | Cavender et al. | 340/854.3 |
| 2010/0126718 | A1 | 5/2010 | Lilley | 166/253.1 |
| 2010/0157739 | A1 | 6/2010 | Slocum et al. | 367/131 |
| 2010/0176813 | A1 | 7/2010 | Simon | 324/339 |
| 2010/0194584 | A1 | 8/2010 | Savage | 340/853.1 |
| 2011/0066378 | A1 | 3/2011 | Lerche et al. | 702/6 |
| 2011/0168403 | A1 | 7/2011 | Patel | 166/373 |
| 2011/0186290 | A1 | 8/2011 | Roddy et al. | 166/253.1 |
| 2011/0275313 | A1 | 11/2011 | Baldemair et al. | 455/17 |
| 2011/0280294 | A1 | 11/2011 | Luo et al. | 375/224 |
| 2011/0297376 | A1 | 12/2011 | Holderman et al. | 166/278 |
| 2012/0004776 | A1 | 1/2012 | Abad | 700/265 |
| 2012/0017673 | A1 | 1/2012 | Godager | 73/152.51 |
| 2012/0024050 | A1 | 2/2012 | Godager | 73/152.05 |
| 2012/0024052 | A1 | 2/2012 | Eriksen | 73/152.51 |
| 2012/0043079 | A1 | 2/2012 | Wassouf et al. | 166/250.01 |
| 2012/0090687 | A1 | 4/2012 | Grigsby et al. | 137/1 |
| 2012/0170410 | A1 | 7/2012 | Hay | 367/82 |
| 2012/0241172 | A1 | 9/2012 | Ludwig et al. | 166/382 |
| 2012/0256415 | A1 | 10/2012 | Dole | 285/337 |
| 2012/0256492 | A1 | 10/2012 | Song et al. | 307/66 |
| 2012/0257475 | A1 | 10/2012 | Luscombe et al. | 367/25 |
| 2012/0292032 | A1 | 11/2012 | Themig et al. | 166/310 |
| 2013/0008648 | A1 | 1/2013 | Lovorn et al. | 166/250.01 |
| 2013/0106615 | A1 | 5/2013 | Prammer | 34/854.6 |
| 2013/0110402 | A1 | 5/2013 | Godager | 702/7 |
| 2013/0175094 | A1 | 7/2013 | Ross et al. | 175/57 |
| 2013/0248172 | A1 | 9/2013 | Angeles Boza et al. | 166/250.01 |

(56) References Cited

U.S. PATENT DOCUMENTS

| | | | | |
|---|---|---|---|---|
| 2013/0248174 | A1 | 9/2013 | Dale et al. | 166/255.1 |
| 2014/0152659 | A1 | 6/2014 | Davidson et al. | 345/420 |
| 2014/0266769 | A1 | 9/2014 | van Zelm | 340/854.3 |
| 2014/0327552 | A1 | 11/2014 | Filas et al. | 340/854.6 |
| 2014/0352955 | A1 | 12/2014 | Tubel et al. | 166/250.15 |
| 2015/0003202 | A1 | 1/2015 | Palmer et al. | 367/82 |
| 2015/0009040 | A1 | 1/2015 | Bowles et al. | 340/854.6 |
| 2015/0027687 | A1 | 1/2015 | Tubel | 166/72 |

FOREIGN PATENT DOCUMENTS

| | | | |
|---|---|---|---|
| WO | WO2010/074766 | 7/2010 | |
| WO | WO2013/079928 | 6/2013 | E21B 47/122 |
| WO | WO2013/079929 | 6/2013 | E21B 44/005 |
| WO | WO2013/112273 | 8/2013 | E21B 47/12 |
| WO | WO2014/018010 | 1/2014 | E21B 47/00 |
| WO | WO2014/049360 | 4/2014 | E21B 47/12 |
| WO | WO2014/134741 | 9/2014 | E21B 47/13 |

* cited by examiner

REMOTELY ACTUATED SCREENOUT RELIEF VALVES AND SYSTEMS AND METHODS INCLUDING THE SAME

CROSS-REFERENCE TO RELATED APPLICATIONS

This application is a divisional of U.S. patent application Ser. No. 15/059,739 filed Mar. 3, 2016 which is the National Stage Application of International Application No. PCT/US2013/076270, filed Dec. 18, 2013 that published as WO 2015/080754, which claims the benefit of U.S. Provisional No. 61/909,161 filed Nov. 26, 2013, and are herein incorporated by reference in their entirety.

FIELD OF THE DISCLOSURE

The present disclosure is directed generally to remotely actuated screenout relief valves, and more particularly to hydrocarbon wells that include and/or utilize the remotely actuated screenout relief valves and/or to methods of operating the remotely actuated screenout relief valves.

BACKGROUND OF THE DISCLOSURE

Certain subterranean formations that include hydrocarbon fluids may require stimulation prior to production of the hydrocarbon fluids therefrom. This stimulation may take a variety of forms, an illustrative, non-exclusive example of which is hydraulic fracturing. In hydraulic fracturing, a portion of the subterranean formation may be pressurized above a fracture pressure thereof, which may facilitate the generation of fractures within the subterranean formation. These fractures may increase a fluid permeability of the subterranean formation and/or may function as a fluid conduit that may convey the hydrocarbon fluids from the subterranean formation into a hydrocarbon well that extends within the subterranean formation.

In certain subterranean formations, the generated fractures may retract, shrink, and/or collapse when the pressure within the subterranean formation is decreased, and it may be desirable to restrict and/or prevent this collapse. This may be accomplished by locating a proppant within the fractures. The proppant may provide a porous medium through which the hydrocarbon fluids may flow while also preventing collapse of the fractures.

The proppant may be flowed into the fractures as a proppant slurry stream via the hydrocarbon well. The proppant slurry stream may include the proppant, which is a particulate and/or other solid, and a fluid, such as water and/or other liquid. Generally, the proppant slurry stream flows from the hydrocarbon well into the fractures via one or more openings that may be present within a casing string that extends within the hydrocarbon well and/or within a wellbore thereof. These openings may include and/or be orifices and/or perforations that may be present within the casing string prior to the casing string being located within the subterranean formation and/or that may be formed within the casing string subsequent to the casing string being located within the subterranean formation.

If one or more of these openings is restricted, blocked, and/or occluded during flow of the proppant slurry stream through the hydrocarbon well, the proppant may collect within the hydrocarbon well and/or within a casing conduit that is defined by the casing string, generating a "screenout" event. Such a screenout event may be costly and/or time-consuming to overcome, as removal of the proppant from the casing conduit may require significant operational resources. Thus, it may be desirable to prevent occurrence of the screenout event and/or respond to occurrence of the screenout event in a more efficient manner. The time and/or expense to overcome a screenout event may be increased when the screenout event prevents flow of fluid through a horizontal portion of the casing conduit to the subterranean formation if the casing conduit does not include a mechanism for enabling, or re-establishing, this fluid flow to the subterranean formation. Thus, there exists a need for remotely actuated screenout relief valves and/or for systems and methods including the same.

SUMMARY OF THE DISCLOSURE

Remotely actuated screenout relief valves and systems and methods including the same are disclosed herein. The methods include providing a proppant slurry stream that includes proppant to a casing conduit that is defined by a casing string that extends within a subterranean formation. The methods further include detecting an operational parameter that is indicative of a screenout event within the casing conduit. Responsive to detecting the operational parameter, the methods include providing a flush fluid stream to the casing conduit, opening the remotely actuated screenout relief valve, and displacing the proppant from the casing conduit into the subterranean formation with the flush fluid stream via the remotely actuated screenout relief valve. The methods may further include closing the remotely actuated screenout relief valve.

In some embodiments, the methods may include ceasing the providing the proppant slurry stream. In some such embodiments, the ceasing occurs prior to the providing the flush fluid stream. In some embodiments, the ceasing is responsive to a manual ceasing input, and in some embodiments the ceasing is responsive to the detecting an operational parameter that is indicative of a screenout event.

In some embodiments, the methods further include determining a location of the screenout event within the casing conduit. In some embodiments, the casing string includes a plurality of remotely actuated screenout relief valves that may be spaced apart along a length of the casing string, and the methods further include selecting a respective one of the plurality of remotely actuated screenout relief valves to be opened. In some embodiments, the selecting may be based, at least in part, on the determined location of the screenout event.

In some embodiments, the methods further include providing a cross-linking gel stream to the casing conduit. In some embodiments, the cross-linking gel stream is provided prior to the flush fluid stream. In some embodiments, the cross-linking gel stream is provided subsequent to the flush fluid stream. In some embodiments, the flush fluid stream is provided both prior to and subsequent to the cross-linking gel stream.

In some embodiments, the methods further include flowing a perforation device into the casing conduit. In some embodiments, the flowing includes flowing the perforation device with the flush fluid stream. In some embodiments, the methods further include perforating the casing string with the perforation device to create a perforation through which fluid and/or proppant from the casing string may flow into the subterranean formation.

In some embodiments, the methods further include determining that the proppant has been displaced from the casing conduit. In some embodiments, the remotely actuated screenout relief valve is closed responsive to determining that the proppant has been displaced from the casing conduit.

In some embodiments, the methods further include resuming the providing the proppant slurry stream. In some embodiments, the resuming is subsequent to the perforating the casing string and/or to the closing the remotely actuated screenout relief valve. In some embodiments, the methods further include providing a ball sealer to the casing conduit. In some embodiments, the ball sealer is utilized to seal or otherwise restrict fluid flow through the perforation.

The systems include hydrocarbon wells that include the remotely actuated screenout relief valve and/or hydrocarbon wells that include controllers that are configured to perform at least a portion of the methods. The systems also include a wellbore, which extends between a surface region and a subterranean formation, and a casing string that extends within the wellbore and defines a casing conduit. The systems further include a proppant supply system, which is configured to provide a proppant slurry stream to the casing conduit, and a detector that is configured to detect a wellbore parameter that is indicative of a screenout event.

In some embodiments, the systems include a wireless communication network that includes a plurality of nodes. In some embodiments, the controller is in wireless communication with the wireless communication network. In some embodiments, the detector is in wireless communication with the wireless communication network. In some embodiments, the remotely actuated screenout relief valve is in wireless communication with the wireless communication network. In some embodiments, the wireless communication network, the detector, and the remotely actuated screenout relief valve form a portion of a screenout response system. In some embodiments, the screenout response system is an automatic screenout response system that is configured to automatically detect and respond to the screenout event.

DETAILED DESCRIPTION AND BEST MODE OF THE DISCLOSURE

Figure 1:
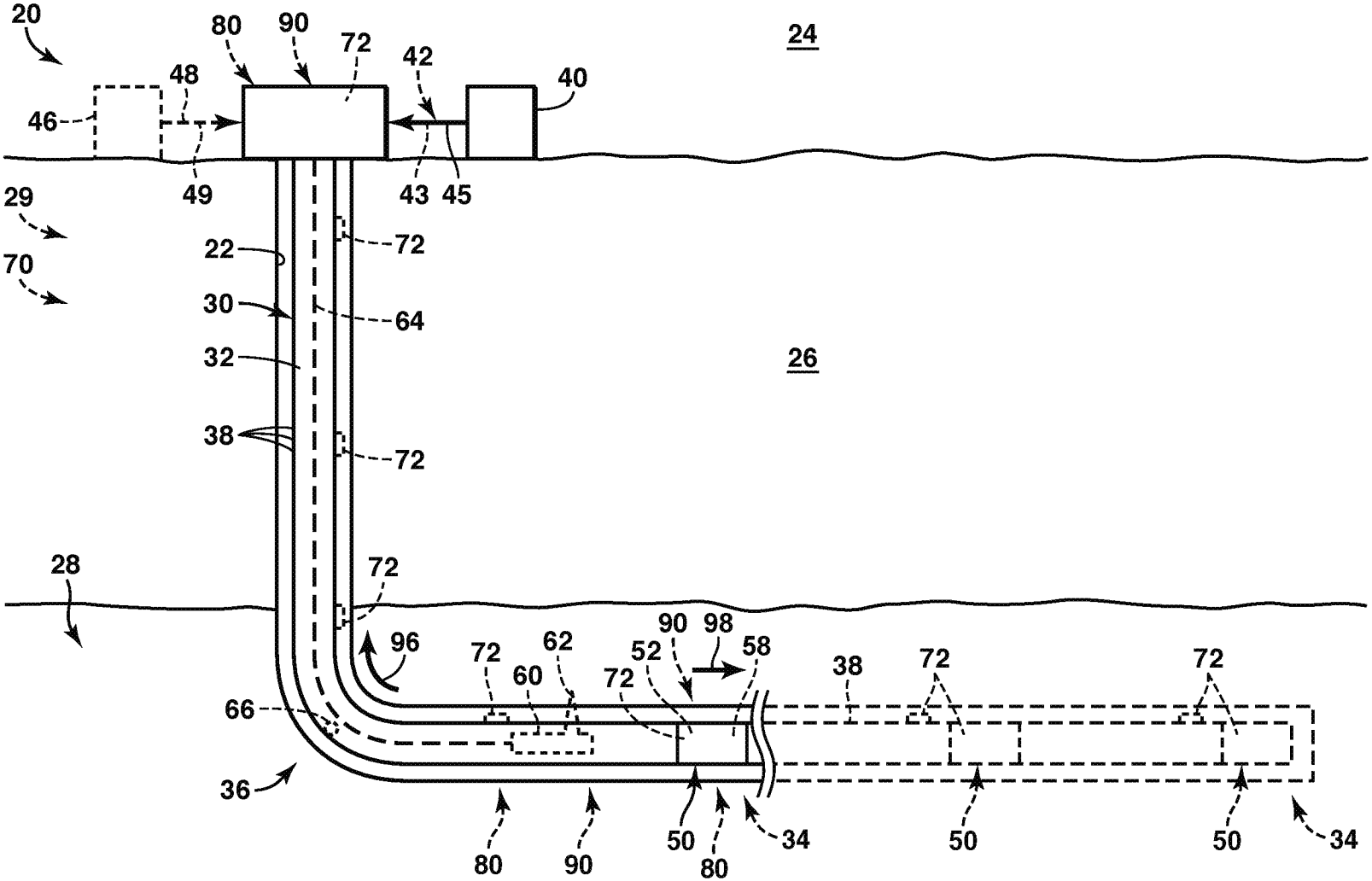
FIG. 1 is a schematic representation of illustrative, non-exclusive examples of a hydrocarbon well that may include and/or utilize the systems and methods according to the present disclosure for providing screenout relief.

FIGS. 1-7 provide illustrative, non-exclusive examples of remotely actuated screenout relief valves 50 according to the present disclosure, of components of remotely actuated screenout relief valves 50, and/or of casing strings 30 and/or hydrocarbon wells 20 that may include and/or utilize remotely actuated screenout relief valves 50. Elements that serve a similar, or at least substantially similar, purpose are labeled with like numbers in each of FIGS. 1-7, and these elements may not be discussed in detail herein with reference to each of FIGS. 1-7. Similarly, all elements may not be labeled in each of FIGS. 1-7, but reference numerals associated therewith may be utilized herein for consistency. Elements, components, and/or features that are discussed herein with reference to one or more of FIGS. 1-7 may be included in and/or utilized with any of FIGS. 1-7 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic representation of illustrative, non-exclusive examples of a hydrocarbon well 20 that may include and/or utilize the systems and methods according to the present disclosure. Hydrocarbon well 20 includes a wellbore 22 that extends between a surface region 24 and a subterranean formation 28 that is present within a subsurface region 26. Wellbore 22 may include and/or define a heel 36 and a toe 34. Heel 36 also may be referred to herein as a transition region 36 between a (substantially) vertical portion of wellbore 22 and a (substantially) horizontal portion of wellbore 22. Toe 34 also may be referred to herein as a terminal end 34 of wellbore 22 and/or as a downhole end 34 of wellbore 22. Wellbore 22 also may be described as defining an uphole direction 96 and a downhole direction 98. Uphole direction 96 is directed along a (longitudinal) length of wellbore 22 toward surface region 24. Conversely, downhole direction 98 is directed along the (longitudinal) length of wellbore 22 away from surface region 24.

A casing string 30 extends within wellbore 22 and defines a casing conduit 32. The casing string may be defined by a plurality of lengths of casing 38 and may include and/or be operatively attached to one or more remotely actuated screenout relief valves 50. Remotely actuated screenout relief valve 50 also may be referred to herein as relief valve 50, remotely actuated valve 50, and/or valve 50.

As used herein, the phrase "casing string" may include and/or be any suitable tubular structure that may be located, may extend, and/or may be placed within wellbore 22 to create and/or define casing conduit 32. As illustrative, non-exclusive examples, casing string 30 also may be referred to herein as and/or may be a wellbore casing 30, tubing 30, and/or a liner 30. Similarly, casing conduit 32 also may be referred to herein as and/or may be a wellbore conduit 32, a tubing conduit 32, and/or a liner conduit 32.

Hydrocarbon well 20 also includes and/or is in fluid communication with a proppant supply system 40. Proppant supply system 40 is configured to provide a proppant 45 to casing conduit 32. Often, proppant 45 may be combined with a fluid 43 to form a proppant slurry stream 42, which may be flowed through the casing conduit. The proppant slurry stream may be generated within proppant supply system 40 and provided to the casing conduit. Additionally or alternatively, proppant 45 and fluid 43 may be separately provided to casing conduit 32 and may combine therein to form proppant slurry stream 42.

Hydrocarbon well 20 further includes a detector 80. Detector 80 is configured to detect an operational parameter that is indicative of a screenout event within hydrocarbon well 20 and/or within casing conduit 32 thereof.

As used herein, the phrase "screenout event" may refer to a velocity reduction, pressure increase, proppant collection, compaction, aggregation, and/or concentration of particulate material, such as proppant 45, within a region of casing conduit 32 such that fluid flow through the region of casing conduit 32 is or may potentially become limited, restricted, blocked, and/or occluded, resulting in an actual or potential increase in wellbore pressure during pumping. This may include limiting fluid flow longitudinally along casing conduit 32 and/or limiting fluid flow from casing conduit 32, through perforations 62, and into subterranean formation 28. Additionally or alternatively, the phrase "screenout event" also may refer to a condition in which continued injection of proppant 45 and/or proppant slurry stream 42 into casing conduit 32 requires the use of injection pressures that are in excess of (or higher than) safe injection pressures for hydrocarbon well 20 and/or for one or more components thereof. The term screenout event refers not only to a completed screenout event but also a predicted screenout event, observed potential for a screenout event, and a screenout event that is occurring.

Remotely actuated screenout relief valve 50 may include any suitable structure that is configured to selectively transition between an open configuration and a closed configuration. In the open configuration, valve 50 permits, provides for, and/or allows fluid communication between casing conduit 32 and subterranean formation 28. In the closed configuration, valve 50 restricts, blocks, and/or occludes fluid communication between the casing conduit and the subterranean formation.

As an illustrative, non-exclusive example, remotely actuated screenout relief valve 50 may include and/or be an electrically powered valve 50. As another illustrative, non-exclusive example, valve 50 may include and/or be a battery powered valve 50. As yet another illustrative, non-exclusive example, valve 50 may include an actuator 58 that is configured to selectively transition the valve between the open configuration and the closed configuration. When valve 50 includes actuator 58, the actuator may include and/or be an electrically powered actuator, a battery-powered actuator, a pneumatically powered actuator, and/or a hydraulically powered actuator.

Remotely actuated screenout relief valve 50 further may include a flow restrictor 52. Flow restrictor 52, when present, may be configured to restrict fluid flow through valve 50 when valve 50 is in the open configuration. For example, flow restrictor 52 may restrict fluid flow through valve 50 to maintain at least a threshold pressure differential across valve 50 when valve 50 is in the open configuration and a fluid is flowing therethrough.

Remotely actuated screenout relief valve 50 may be present and/or located at any suitable location within hydrocarbon well 20. As an illustrative, non-exclusive example, valve 50 may be located proximal to toe 34 of wellbore 22, as illustrated in solid lines in FIG. 1. As another illustrative, non-exclusive example, valve 50 may be located downhole (or in downhole direction 98) from heel 36 of wellbore 22. As yet another illustrative, non-exclusive example, one or more valves 50 may be located between heel 36 and toe 34, as illustrated in dashed lines in FIG. 1. As another illustrative, non-exclusive example, hydrocarbon well 20 may include a plurality of valves 50 that may be spaced apart along at least a portion of a longitudinal length of casing string 30.

Remotely actuated screenout relief valve 50 may be located within hydrocarbon well 20 in any suitable manner. As an illustrative, non-exclusive example, valve 50 may be operatively attached to one or more lengths of casing 38. As another illustrative, non-exclusive example, valve 50 may be located between a respective pair of lengths of casing 38. As yet another illustrative, non-exclusive example, valve 50 may function as and/or may be a coupling that operatively attaches the respective pair of lengths of casing 38 to one another.

Detector 80 may include any suitable structure that may be configured to detect the operational parameter that is indicative of the screenout event. As illustrative, non-exclusive examples, detector 80 may include and/or be a downhole pressure detector and/or a downhole acoustic detector. Illustrative, non-exclusive examples of the operational parameter include a wellbore pressure, a wellbore pressure differential, and/or a density of proppant 45 and/or proppant slurry stream 42 within casing conduit 32.

As illustrated in dashed lines in FIG. 1, hydrocarbon well 20 further may include a flush fluid supply system 46. Flush fluid supply system 46 may be configured to provide a flush fluid stream 48 and/or a cross-linking gel stream 49 to casing conduit 32, as discussed in more detail herein.

As also illustrated in dashed lines in FIG. 1, hydrocarbon well 20 may include a controller 90. Controller 90 may be adapted, configured, designed, and/or programmed to control the operation of at least a portion of hydrocarbon well 20. As an illustrative, non-exclusive example, controller 90 may control the operation of the portion of hydrocarbon well 20 based, at least in part, on the operational parameter that is detected by detector 80. As another illustrative, non-exclusive example, controller 90 may control the operation of the portion of hydrocarbon well 20 by performing methods 100, which are discussed in more detail herein.

As a more specific but still illustrative, non-exclusive example, controller 90 may control the operation of remotely actuated screenout relief valve 50. This may include opening valve 50 responsive to the operational parameter indicating a screenout event and/or opening valve 50 to permit proppant 45 to be displaced from casing conduit 32. Additionally or alternatively, this also may include closing valve 50 subsequent to the proppant being (at least substantially) displaced from the casing conduit.

Controller 90 may be present at any suitable location within hydrocarbon well 20 in which the controller is in communication with (i.e., at least able to send control signals to) the valve(s) 50 and/or other portions of the hydrocarbon well to be controlled. As an illustrative, non-exclusive example, controller 90 may be present within surface region 24. As another illustrative, non-exclusive example, controller 90 may be present within wellbore 22. As yet another illustrative, non-exclusive example, controller 90 may be operatively attached to, integral with, and/or may form a portion of remotely actuated screenout relief valve 50.

It is within the scope of the present disclosure that controller 90 may be configured to generate a control signal that may be utilized to control the operation of valve 50. As an illustrative, non-exclusive example, valve 50 may be configured to transition between the open configuration and the closed configuration responsive to receipt of the control signal. Illustrative, non-exclusive examples of the control signal include any suitable electrical control signal, acoustic control signal, hydraulic control signal, wireless control signal, and/or electromagnetic control signal.

As further illustrated in dashed lines in FIG. 1, hydrocarbon well 20 also may include and/or be utilized with a wireless communication network 70. Wireless communication network 70 may include a plurality of nodes 72 that may be operatively attached to, may form a portion of, and/or may be spaced apart along the longitudinal length of casing string 30. Nodes 72 may be in wireless data communication with one another and/or may be configured to transfer, convey, and/or relay any suitable wireless signal therebetween.

As an illustrative, non-exclusive example, controller 90 may be configured to convey a control signal to remotely actuated screenout relief valve 50 via one or more of the plurality of nodes 72. Thus, remotely actuated screenout relief valve 50 and/or controller 90 may be referred to herein as being in wireless data communication with the plurality of nodes 72, as being in wireless communication with one another, and/or as being in wireless communication with one another via the plurality of nodes 72.

As another illustrative, non-exclusive example, controller 90 may be configured to receive a data signal from detector 80 via one or more of the plurality of nodes 72. As yet another illustrative, non-exclusive example, controller 90 and/or detector 80 may form a portion of, be integral with, and/or be operatively attached to one or more of the plurality of nodes 72. Thus, detector 80 may be referred to herein as being in wireless data communication with the plurality of nodes 72 and/or with controller 90.

When hydrocarbon well 20 includes wireless communication network 70, nodes 72, detector 80, and remotely actuated screenout relief valve 50, these components collectively may be referred to herein as a screenout response system 29, which optionally may include and/or be an automatic screenout response system 29. Automatic screenout response system 29 may be configured to automatically respond to a screenout event within hydrocarbon well 20 and/or casing conduit 32 thereof. As an illustrative, non-exclusive example, detector 80 may detect the operational parameter that is indicative of the screenout event. Automatic screenout response system 29 then may be adapted, configured, designed, constructed, and/or programmed to control the operation of automatic screenout relief valve 50 based, at least in part, on the operational parameter (or a value of the operational parameter).

As also illustrated in dashed lines in FIG. 1, hydrocarbon well 20 further may include and/or be utilized with a perforation device 60, which may be located within casing conduit 32. Perforation device 60 may be configured to create one or more perforations 62 within casing string 30. It is within the scope of the present disclosure that perforation device 60 may include and/or be any suitable structure. As an illustrative, non-exclusive example, perforation device 60 may include and/or be a wireline-attached perforation device 60 that is attached to a wireline 64.

As another illustrative, non-exclusive example, perforation device 60 may include and/or be an autonomous perforation device 60. Autonomous perforation device 60 may be configured to be located within casing conduit 32 from, or proximal to, surface region 24, and to be flowed through casing conduit 32 with any suitable fluid flow. The autonomous perforation device may not include and/or be attached to wireline 64. Instead, the autonomous perforation device may be configured to autonomously, or automatically, detect and/or determine its location within casing conduit 32 and to create and/or generate one or more perforations 62 when the autonomous perforation device reaches a target, or desired, location within casing conduit 32. Generally, autonomous perforation devices 60 may be single-use perforation devices that may not be configured to generate additional perforations within casing string 30 subsequent to generation of the one or more perforations 62.

Perforation device 60, whether a wireline-attached perforation device or an autonomous perforation device, may be flowed into casing conduit 32 from surface region 24 with the fluid flow. However, and during a screenout event, fluid flow through casing conduit 32 may be restricted and/or blocked. This may prevent the perforation device from being located within the target location within casing conduit 32. Thus, and prior to creating additional perforations within casing string 30, it may be necessary to remove and/or relieve the screenout event from the casing conduit.

As discussed in more detail herein, a screenout event may be associated with perforation 62 and/or may be associated with plugging, blocking, occluding, and/or restricting fluid flow through perforation 62 during supply of proppant slurry stream 42 to casing conduit 32. As such, and as illustrated in FIG. 1, one or more remotely actuated screenout relief valves 50 may be located downhole from perforation device 60 and/or perforation 62 that is created thereby. This may permit proppant 45, which may be associated with and/or may be contributing to the screenout event, to be removed from casing conduit 32 via opening of valve 50, re-establishing fluid flow within casing conduit 32 and/or permitting perforation device 60 to flow through the casing conduit.

As further illustrated in dashed lines, hydrocarbon well 20 also may include and/or be utilized with a ball sealer 66. Ball sealer 66 may be located within, present within, and/or flowed into casing conduit 32, such as to seal perforation 62, as discussed in more detail herein.

FIGS. 2-6 are schematic cross-sectional views of illustrative, non-exclusive examples of a portion of a hydrocarbon well 20 that includes a remotely actuated screenout relief valve 50 according to the present disclosure. FIGS. 2-6 illustrate process flows that may be utilized with and/or performed in hydrocarbon wells 20 according to the present disclosure. It is within the scope of the present disclosure that any of the process flows, features, and/or components that are discussed herein with reference to FIGS. 2-6 may be utilized with, performed in, and/or included in hydrocarbon wells 20 of FIG. 1.

Hydrocarbon wells 20 of FIGS. 2-6 include a wellbore 22 that extends within a subterranean formation 28. A casing string 30 extends within wellbore 22 and defines a casing conduit 32. Casing string 30 includes one or more perforations 62, and remotely actuated screenout relief valve 50 is located downhole from perforations 62. The remotely actuated screenout relief valve is configured to selectively control fluid flow therethrough, as discussed in more detail herein.

Figure 2:
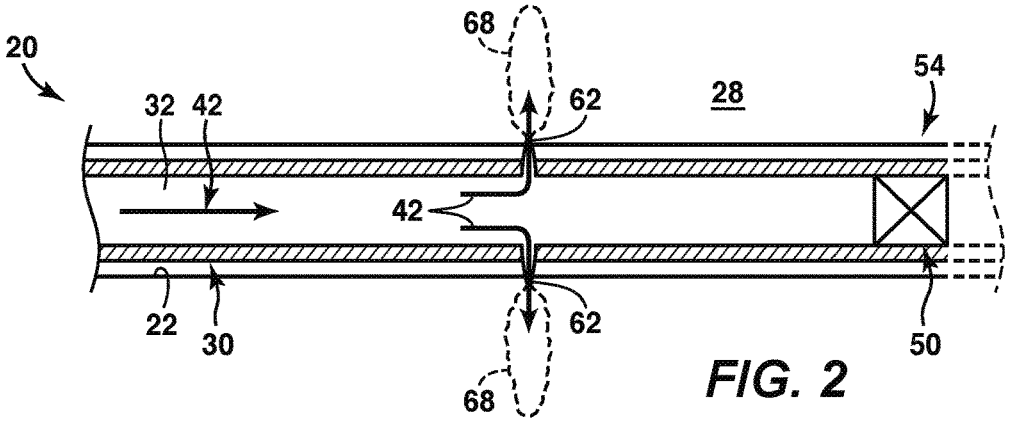
FIG. 2 is a schematic fragmentary cross-sectional view of an illustrative, non-exclusive example of a portion of a hydrocarbon well that includes a remotely actuated screenout relief valve according to the present disclosure.

As illustrated in FIG. 2, valve 50 initially may be in a closed configuration 54, and a proppant slurry stream 42 may be provided to casing conduit 32. The proppant slurry stream may flow from the casing conduit, through perforations 62, into subterranean formation 28. Generally, this flow of proppant slurry stream 42 into subterranean formation 28 may be utilized to create stimulated regions 68 within the subterranean formation and/or to prevent collapse of previously created fractures within stimulated regions 68.

Figure 3:
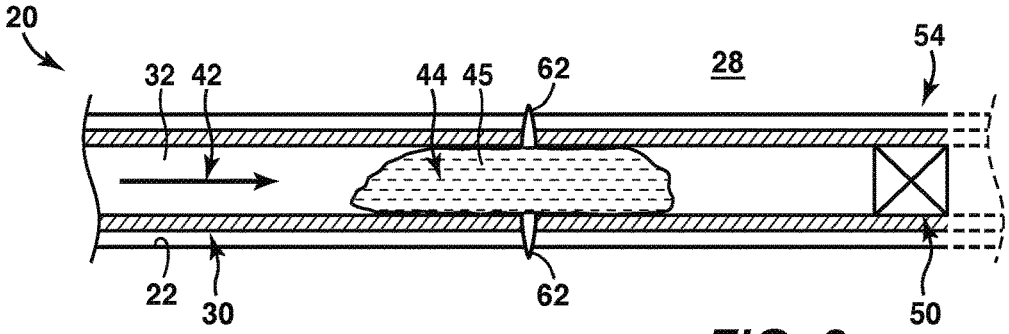
FIG. 3 is another schematic fragmentary cross-sectional view of an illustrative, non-exclusive example of a portion of a hydrocarbon well that includes a remotely actuated screenout relief valve according to the present disclosure.

However, and should flow of proppant slurry stream 42 through one or more perforations 62 become blocked, restricted, and/or occluded, proppant 45 (and/or other particulate material) from proppant slurry stream 42 may collect within casing conduit 32. As illustrated in FIG. 3, this proppant 45 may contribute to the occurrence, generation, and/or presence of a screenout event 44 within casing conduit 32.

In hydrocarbon wells that do not include hydraulically actuated screenout relief valve 50, this screenout event may completely block fluid flow through casing conduit 32. Thus, and in the hydrocarbon wells that do not include valve 50, it may be necessary to cease the supply of proppant slurry stream 42 to the casing conduit and subsequently remove proppant 45 from the casing conduit. This is a labor-intensive and equipment-intensive process that may significantly increase the overall costs associated with fracturing and/or stimulation of the subterranean formation.

Figure 4:
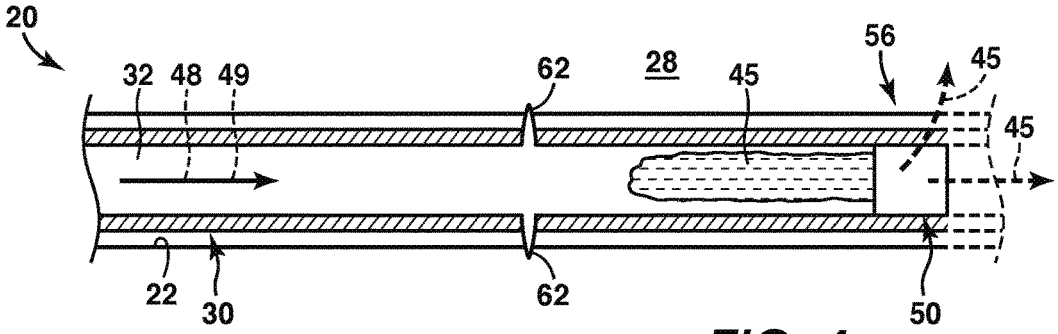
FIG. 4 is another schematic fragmentary cross-sectional view of illustrative, non-exclusive examples of a portion of a hydrocarbon well that includes a remotely actuated screenout relief valve according to the present disclosure.

In contrast, and as illustrated in FIG. 4, hydrocarbon wells 20 that include remotely actuated screenout relief valves 50 according to the present disclosure may respond to the screenout event by transitioning valve 50 to open configuration 56. This may permit proppant 45 to flow through valve 50 and into subterranean formation 28, thereby removing and/or relieving the screenout event from the casing conduit.

As also illustrated in FIG. 4, responsive to detecting the screenout event, the systems and methods according to the present disclosure may cease supply of the proppant slurry stream and instead may provide a flush fluid stream 48 and/or a cross-linking gel stream 49 to the casing conduit. Flush fluid stream 48 may be an at least substantially particulate-free fluid stream that may flush proppant 45 from the casing conduit. Cross-linking gel stream 49 may be selected to at least temporarily gel within subterranean formation 28, thereby at least temporarily restricting flow of proppant 45 from subterranean formation 28 into casing conduit 32, such as subsequent to the proppant being removed from the casing conduit.

Figure 5:
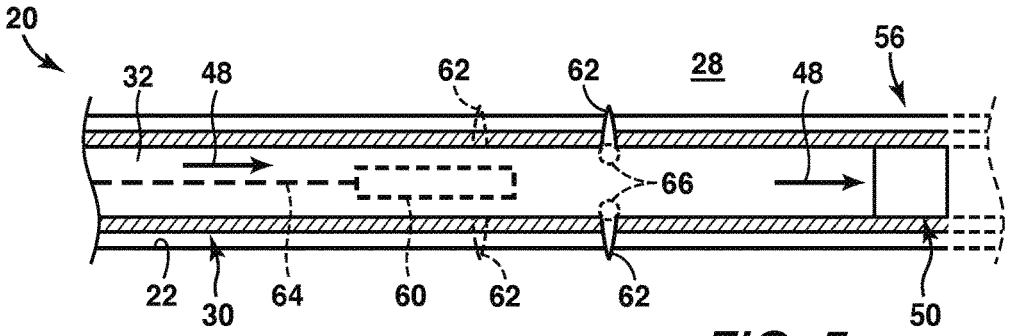
FIG. 5 is another schematic fragmentary cross-sectional view of illustrative, non-exclusive examples of a portion of a hydrocarbon well that includes a remotely actuated screenout relief valve according to the present disclosure.

Once the proppant has been (at least substantially) removed from casing conduit 32, such as being displaced into the subterranean formation with flush fluid stream 48 via remotely actuated screenout relief valve 50, and as illustrated in FIG. 5, one or more ball sealers 66 may be flowed through the casing conduit with flush fluid stream 48 and/or may be flowed into contact with the one or more perforations 62 that were present within casing string 30. A perforation device 60 also may be flowed through casing conduit 32 with flush fluid stream 48 and utilized to create one or more additional perforations 62 within casing string 30.

Figure 6:
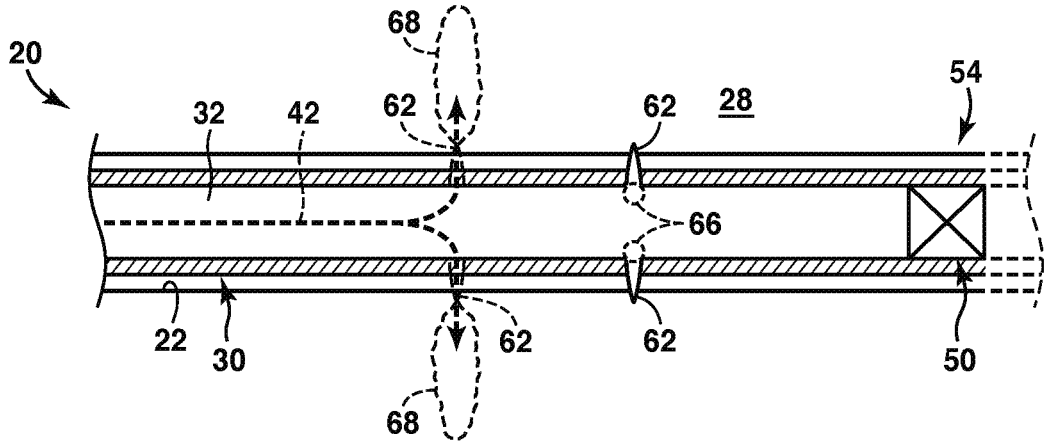
FIG. 6 is another schematic fragmentary cross-sectional view of illustrative, non-exclusive examples of a portion of a hydrocarbon well that includes a remotely actuated screenout relief valve according to the present disclosure.

As illustrated in FIG. 6, remotely actuated screenout relief valve 50 further may be returned and/or transitioned to closed configuration 54, thereby restricting and/or preventing fluid flow therethrough. In addition, proppant slurry stream 42 again may be provided to casing conduit 32. The proppant slurry stream may flow through additional perforations 62 into subterranean formation 28, such as to create one or more stimulated regions 68 therein.

Figure 7:
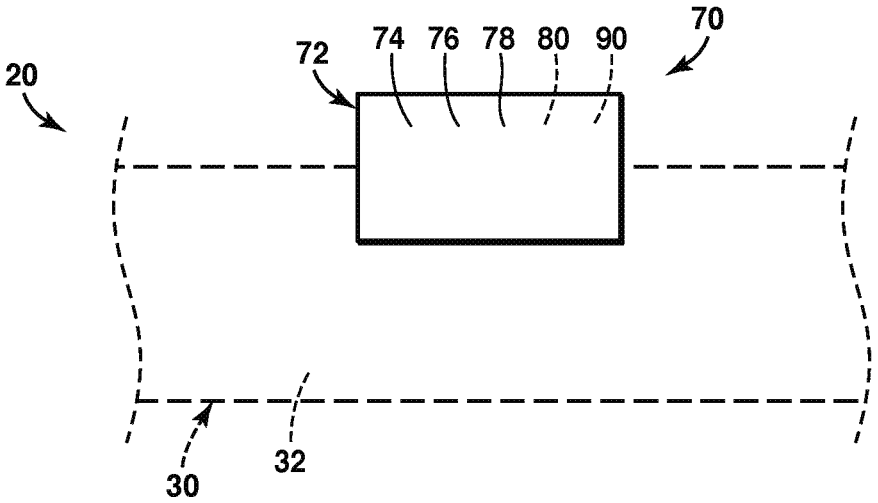
FIG. 7 is a schematic representation of illustrative, non-exclusive examples of a node of a wireless communication network that may be utilized with and/or included in the systems and methods according to the present disclosure.

FIG. 7 is a schematic representation of illustrative, non-exclusive examples of a node 72 of a wireless communication network 70 that may be utilized with and/or included in the systems and methods according to the present disclosure. As illustrated in dashed lines in FIG. 7, node 72 may be located internal and/or external to a casing conduit 32 that is defined by a casing string 30 that may form a portion of a hydrocarbon well 20.

Node 72 may include a plurality of different structures. As an illustrative, non-exclusive example, node 72 may include a power source 74, such as a battery, that may be configured to power the operation of and/or to provide an electric current to node 72. As another illustrative, non-exclusive example, node 72 additionally or alternatively may include a transmitter 76 that may be configured to generate and/or to transmit a wireless signal to another node 72 of wireless communication network 70. As yet another illustrative, non-exclusive example, node 72 additionally or alternatively may include a receiver 78 that may be configured to receive a wireless signal from another node 72 of wireless communication network 70 and/or from controller 90. As additional illustrative, non-exclusive examples, node 72 may include detector 80 and/or controller 90.

Figure 8:
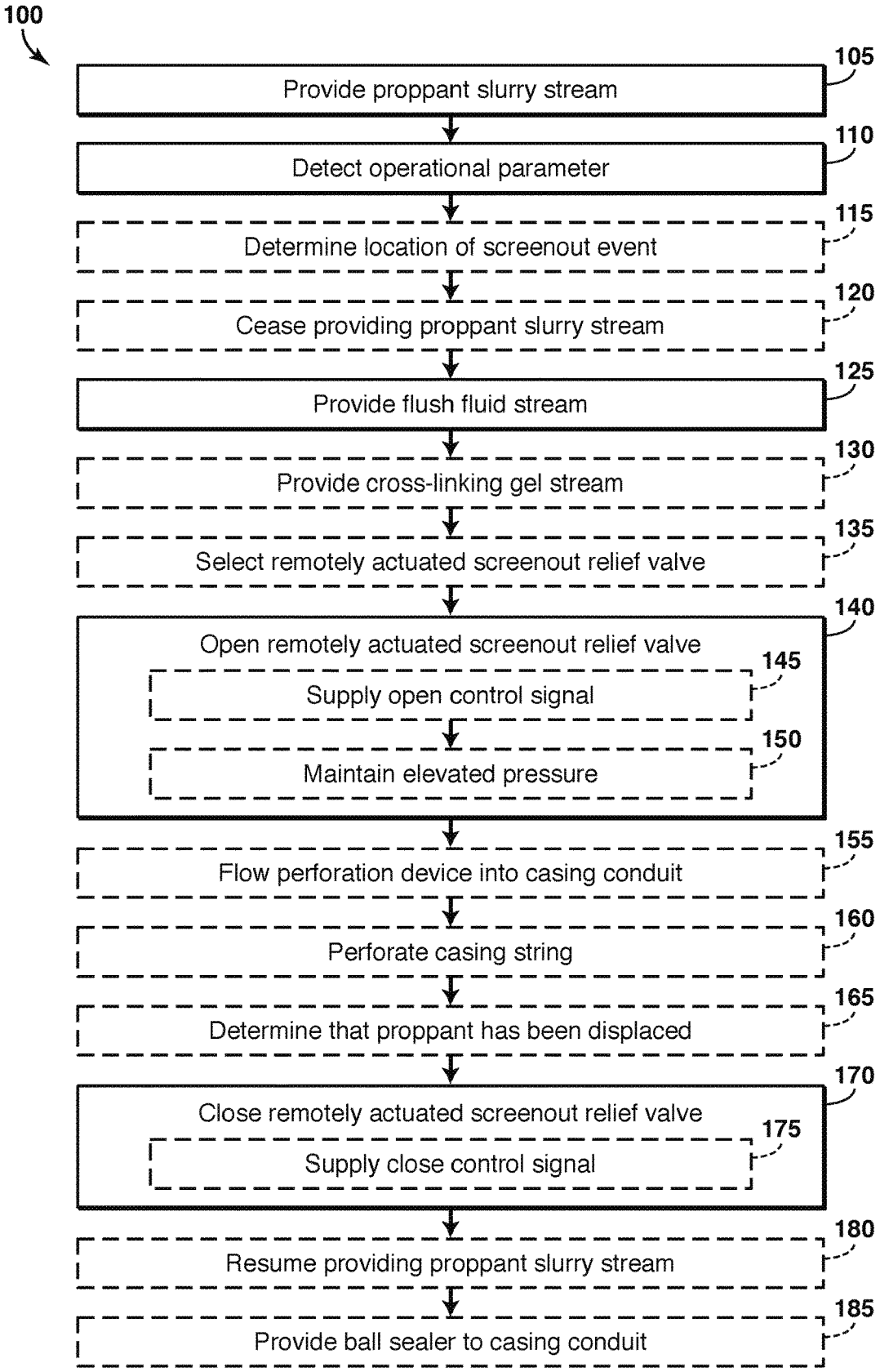
FIG. 8 is a flowchart depicting methods according to the present disclosure of responding to a screenout event.

FIG. 8 is a flowchart depicting methods 100 according to the present disclosure of responding to a screenout event. Methods 100 include providing a proppant slurry stream containing a proppant to a casing conduit at 105 and detecting an operational parameter at 110. Methods 100 may include determining a location of a screenout event at 115 and/or ceasing the providing the proppant slurry stream at 120 and include providing a flush fluid stream to the casing conduit at 125. Methods 100 further may include providing a cross-linking gel stream to the casing conduit at 130 and/or selecting a remotely actuated screenout relief valve at 135, and methods 100 include opening the remotely actuated screenout relief valve at 140 and displacing the proppant from the casing conduit into the subterranean formation at 152. Methods 100 further may include flowing a perforation device into the casing conduit at 155, perforating a casing string that defines the casing conduit at 160, and/or determining that the proppant has been displaced from the casing conduit at 165. Methods 100 further include closing the remotely actuated screenout relief valve at 170 and may include resuming the providing the proppant slurry stream at 180 and/or providing a ball sealer to the casing conduit at 185.

Providing the proppant slurry stream at 105 may include providing the proppant slurry stream to the casing conduit that is defined by the casing string. The casing string may extend within a wellbore that extends between a surface region and a subterranean formation, and the providing at 105 may include providing from the surface region, such as by pumping the proppant slurry stream into the casing conduit. It is within the scope of the present disclosure that the proppant slurry stream may include and/or be any suitable slurry stream, such as a slurry stream that includes a liquid and a proppant. Under these conditions, the providing at 105 may include providing the liquid and also providing the proppant. This may include providing the liquid and the proppant as a single proppant slurry stream and/or providing the liquid and the proppant as separate streams that combine within the casing conduit to form the proppant slurry stream. Additional illustrative, non-exclusive examples of the proppant slurry stream are disclosed herein.

Detecting the operational parameter at 110 may include detecting any suitable operational parameter that may indicate, suggest, correlate with, correspond to, and/or be indicative of the screenout event. As an illustrative, non-exclusive example, the detecting at 110 may include detecting a wellbore pressure and/or detecting that the wellbore pressure is greater than a threshold screenout pressure. As another illustrative, non-exclusive example, the detecting at 110 may include detecting a wellbore pressure differential and/or detecting that the wellbore pressure differential is greater than a threshold wellbore screenout pressure differential. The wellbore pressure differential may be a difference between a first pressure, which may be detected uphole from the screenout event, and a second pressure, which may be detected downhole from the screenout event. As yet another illustrative, non-exclusive example, the detecting at 110 may include detecting a density of the proppant and/or of the proppant slurry stream within the casing conduit and/or detecting that the density of the proppant and/or of the proppant slurry stream is greater than a threshold screenout density. Additional illustrative, non-exclusive examples of the operational parameter are disclosed herein.

The detecting at 110 may include detecting in any suitable manner and/or at any suitable location. As an illustrative, non-exclusive example, the detecting at 110 may include detecting with a detector, illustrative, non-exclusive examples of which are disclosed herein. As additional illustrative, non-exclusive examples, the detecting at 110 may include detecting in (or within) the casing conduit, detecting in (or within) a heel of the casing string, detecting in (or within) a toe of the casing string, detecting uphole from the remotely actuated screenout relief valve, detecting downhole from the remotely actuated screenout relief valve, detecting proximal to (or within) the surface region, detecting in (or within) a liner conduit of a liner that extends within the wellbore, and/or detecting in (or within) a tubing string that extends within the wellbore.

Determining the location of the screenout event at 115 may include determining the location of the screenout event in any suitable manner. As an illustrative, non-exclusive example, the hydrocarbon well may include a plurality of detectors, and the determining at 115 may include determining which of the plurality of detectors is detecting the operational parameter that is indicative of the screenout event. As another illustrative, non-exclusive example, a location within the casing string of perforation(s) that may be associated with the screenout event may be (at least approximately) known, and the determining at 115 may include determining which perforation(s) are associated with the screenout event.

It is within the scope of the present disclosure that the determining at 115 may include determining an exact and/or a precise location of the screenout event within the casing conduit. However, it is also within the scope of the present disclosure that the determining at 115 may include determining an approximate location of the screenout event within the casing conduit and/or determining a sub-portion of the casing conduit that includes the screenout event. As a further example, the determining at 115 may include determining a node 70 and/or screenout relief valve 50 that is uphole from, closest to, and/or otherwise proximate the screenout event.

Ceasing the providing the proppant slurry stream at 120 may include ceasing in any suitable manner. As an illustrative, non-exclusive example, the ceasing at 120 may include automatically ceasing the providing the proppant slurry stream responsive to the detecting at 110. As another illustrative, non-exclusive example, the ceasing at 120 also may include manually ceasing the providing the proppant slurry stream, such as responsive to a manual ceasing input. As yet another illustrative, non-exclusive example, the ceasing at 120 may include ceasing a flow of the proppant slurry stream into the casing conduit. As another illustrative, non-exclusive example, the ceasing at 120 may include closing a proppant supply valve to restrict the flow of the proppant slurry stream into the casing conduit. The ceasing at 120 may be initiated subsequent to the detecting at 110 and/or may be initiated responsive to the detecting at 110.

Providing the flush fluid stream to the casing conduit at 125 may include providing any suitable flush fluid stream in any suitable manner. As an illustrative, non-exclusive example, the providing at 125 may include providing a fluid stream that does not include proppant. As another illustrative, non-exclusive example, the providing at 125 may include providing a liquid stream. As yet another illustrative, non-exclusive example, the providing at 125 may include providing water.

It is within the scope of the present disclosure that the providing at 125 may include providing a volume of the flush fluid stream that is sufficient to displace at least a threshold fraction of the proppant from the casing conduit. Illustrative, non-exclusive examples of the threshold fraction of the proppant include at least 70 volume percent, at least 75 volume percent, at least 80 volume percent, at least 85 volume percent, at least 90 volume percent, at least 95 volume percent, at least 97.5 volume percent, at least 99 volume percent, or 100 volume percent of the proppant that is present within the casing conduit prior to the providing at 125.

Additionally or alternatively, it is also within the scope of the present disclosure that the providing at 125 may include providing at least a threshold volume of the flush fluid stream. As an illustrative, non-exclusive example, a portion of the casing conduit that is uphole from the screenout event may define an uphole casing conduit volume, and the threshold volume of the flush fluid stream may be selected to be greater than the uphole casing conduit volume. As illustrative, non-exclusive examples, the threshold volume of the flush fluid stream may be at least 100%, at least 105%, at least 110%, at least 115%, at least 120%, at least 125%, at least 130%, at least 140%, at least 150%, at least 160%, at least 170%, at least 180%, at least 190%, or at least 200% of the uphole casing conduit volume.

It is within the scope of the present disclosure that the providing at 125 may be initiated at any suitable time and/or may be performed with any suitable sequence within methods 100. As an illustrative, non-exclusive example, the providing at 125 may be initiated and/or performed subsequent to the ceasing at 120. As another illustrative, non-exclusive example, the providing at 125 may be initiated and/or performed subsequent to the detecting at 110 and/or may be initiated and/or performed responsive to the detecting at 110. As yet another illustrative, non-exclusive example, the providing at 125 may include manually initiating the providing the flush fluid stream, such as responsive to receipt of a flush fluid stream manual input. As another illustrative, non-exclusive example, the providing at 125 also may include automatically initiating the providing the flush fluid stream, such as responsive to the detecting at 110.

Providing the cross-linking gel stream to the casing conduit at 130 may include providing any suitable cross-linking gel stream in any suitable manner. As an illustrative, non-exclusive example, and as discussed, the providing at 130 may include providing the cross-linking gel stream to retain proppant from the proppant slurry stream within the subterranean formation. As another illustrative, non-exclusive example, the providing at 130 further may include flowing the cross-linking gel stream from the casing conduit and into the subterranean formation. As yet another illustrative, non-exclusive example, the providing at 130 further may include cross-linking the cross-linking gel stream within the subterranean formation to form a cross-linked gel network external to the casing conduit and/or within the subterranean formation.

It is also within the scope of the present disclosure that the providing at 130 may include providing at least a threshold volume of the cross-linking gel stream to the casing conduit. Under these conditions, the providing at 130 further may include selecting the threshold volume of the cross-linking gel stream. As an illustrative, non-exclusive example, the threshold volume of the cross-linked gel stream may be selected such that the cross-linked gel network at least temporarily retains the proppant external to the casing conduit and/or within the subterranean formation.

It is within the scope of the present disclosure that the providing at 130 may be initiated at any suitable time and/or may be performed with any suitable sequence within methods 100. As an illustrative, non-exclusive example, the providing at 130 may be initiated and/or performed subsequent to the providing at 125. As another illustrative, non-exclusive example, the providing at 130 may be initiated and/or performed prior to the providing at 125. As an illustrative, non-exclusive example, methods 100 may include providing the flush fluid stream via the providing at 125, subsequently providing the cross-linking gel stream via the providing at 130, and subsequently repeating the providing at 125 to displace a portion of and/or the entire cross-linking gel stream from the casing conduit and into the subterranean formation. As another illustrative, non-exclusive example, the providing at 130 may be initiated subsequent to the detecting at 110 and/or may be initiated responsive to the detecting at 110.

As discussed, the hydrocarbon well may include a plurality of remotely actuated screenout relief valves, such as valves 50, that may be spaced apart along a longitudinal length of the casing string. Under these conditions, the opening at 140 may include opening a respective one of the plurality of remotely actuated screenout relief valves, and methods 100 further may include selecting the respective one of the plurality of remotely actuated screenout relief valve at 135.

The selecting at 135 may be based upon any suitable criteria. As an illustrative, non-exclusive example, the respective one of the plurality of screenout relief valves may be selected based upon the location of the screenout event within the casing conduit, such as was determined during the determining at 115. As another illustrative, non-exclusive example, the selecting at 135 may include selecting such that the respective one of the plurality of remotely actuated screenout relief valves is downhole from (or located in a downhole direction from) the screenout event.

Opening the remotely actuated screenout relief valve at 140 may include opening the remotely actuated screenout relief valve to permit the flush fluid stream to (at least partially) displace the proppant from the casing conduit. This may include flowing the proppant from the casing conduit through, or via, the remotely actuated screenout relief valve and/or establishing fluid communication between the casing conduit and the subterranean formation through, or via, the remotely actuated screenout relief valve.

It is within the scope of the present disclosure that the opening at 140 may be initiated at any suitable time and/or may be performed with any suitable sequence within methods 100. As an illustrative, non-exclusive example, the opening at 140 may be initiated and/or performed prior to the providing at 125. As another illustrative, non-exclusive example, the opening at 140 may be initiated and/or performed subsequent to the providing at 125. As yet another illustrative, non-exclusive example, the opening at 140 may be initiated and/or performed concurrently with the providing at 125. As another illustrative, non-exclusive example, the opening at 140 may be initiated and/or performed subsequent to the detecting at 110 and/or may be initiated and/or performed responsive to the detecting at 110.

The opening at 140 may be initiated in any suitable manner. As an illustrative, non-exclusive example, the opening at 140 may include opening responsive to receipt of a relief valve manual open input, such as may be provided by an operator of the hydrocarbon well. As another illustrative, non-exclusive example, the opening at 140 additionally or alternatively may include automatically opening the remotely actuated screenout relief valve responsive to the detecting at 110.

The systems and methods disclosed herein may permit and/or facilitate quick and/or rapid opening of the remotely actuated screenout relief valve. As an illustrative, non-exclusive example, the opening at 140 may include opening the remotely actuated screenout relief valve within a threshold time of the detecting at 110. Illustrative, non-exclusive examples of the threshold time include threshold times of less than (or within) 5 seconds, less than 10 seconds, less than 15 seconds, less than 20 seconds, less than 25 seconds, less than 30 seconds, less than 40 seconds, less than 50 seconds, or less than 60 seconds. Additionally or alternatively, the opening at 140 also may include opening the remotely actuated screenout relief valve prior to complete blockage of the casing conduit by the screenout event and/or prior to complete blockage of fluid flow through, or past, the screenout event within the casing conduit.

The opening at 140 further may include supplying, at 145, an open control signal to the remotely actuated screenout relief valve. Under these conditions, the opening at 140 may include opening responsive to receipt of the open control signal by the remotely actuated screenout relief valve. Illustrative, non-exclusive examples of the open control signal include an electric open control signal, an acoustic open control signal, a hydraulic open control signal, a wireless open control signal, and/or an electromagnetic open control signal.

When methods 100 include the supplying at 145, methods 100 further may include generating the open control signal and conveying the open control signal to the remotely actuated screenout relief valve. As an illustrative, non-exclusive example, the generating may include generating the open control signal at, near, and/or within the surface region. As another illustrative, non-exclusive example, the generating may include generating the open control signal within the casing conduit. As yet another illustrative, non-exclusive example, the hydrocarbon well may include a wireless communication network that includes a plurality of nodes, and the conveying may include conveying the open control signal with, or via, the plurality of nodes. Illustrative, non-exclusive examples of the wireless communication network and/or of the plurality of nodes are disclosed herein.

The opening at 140 also may include maintaining, at 150, an elevated pressure within the casing conduit relative to the subterranean formation. This may include maintaining during the providing at 125, maintaining subsequent to the opening at 140, and/or maintaining during, or until, the closing at 170. As an illustrative, non-exclusive example, the remotely actuated screenout relief valve may include a flow restrictor, and the maintaining at 150 may include maintaining with the flow restrictor. As another illustrative, non-exclusive example, the maintaining at 150 also may include maintaining at least a threshold pressure differential across the remotely actuated screenout relief valve subsequent to the opening at 140 and prior to the closing at 170. An illustrative, non-exclusive example of the threshold pressure differential may include and/or be a pressure differential that is sufficient to retain a ball sealer seated on a perforation that is present within the casing string subsequent to the opening at 140 and prior to the closing at 170.

Displacing proppant from the casing conduit into the subterranean formation at 152 includes displacing the proppant with the flush fluid stream via the remotely actuated screenout relief valve. In other words, the opening of the remotely actuated screenout relief valve provides a flow path for proppant within the casing conduit to be displaced into the subterranean formation, and the flush fluid stream may provide a motive force to drive or otherwise assist this displacement.

Flowing the perforation device into the casing conduit at 155 may include flowing any suitable perforation device, illustrative, non-exclusive examples of which are disclosed herein, into the casing conduit. As an illustrative, non-exclusive example, the flowing at 155 may include flowing with the flush fluid stream and/or flowing concurrently with the providing at 125.

Perforating the casing string at 160 may include creating and/or generating one or more perforations within the casing string. It is within the scope of the present disclosure that the perforating at 160 may be initiated at any suitable time and/or may be performed with any suitable sequence within methods 100. As illustrative, non-exclusive examples, the perforating at 160 may be initiated and/or performed prior to the closing at 170 and/or subsequent to the closing at 170.

Determining that the proppant has been displaced from the casing conduit at 165 may include determining in any suitable manner. As an illustrative, non-exclusive example, the determining at 165 may include determining that the operational parameter is no longer indicative of the screenout event. As more specific but still illustrative, non-exclusive examples, the determining at 165 may include determining that the wellbore pressure is less than the threshold screenout pressure, determining that the wellbore pressure differential is less than the threshold wellbore screenout pressure differential, determining that the density of the proppant and/or of the proppant slurry stream within the casing conduit is less than the threshold screenout density, determining that the threshold volume of the flush fluid stream has been provided to the casing conduit, and/or determining that the threshold volume of the cross-linking gel stream has been provided to the casing conduit. When methods 100 include the determining at 165, methods 100 further may include automatically initiating the closing at 170 responsive to and/or based, at least in part, on the determining at 165.

Closing the remotely actuated screenout relief valve at 170 may include closing subsequent to the proppant being (at least substantially) displaced from the casing conduit and may be accomplished in any suitable manner. As an illustrative, non-exclusive example, the closing at 170 may include restricting, blocking, limiting, and/or occluding fluid communication between the casing conduit and the subterranean formation via the remotely actuated screenout relief valve. As another illustrative, non-exclusive example, the closing at 170 may include manually closing the remotely actuated screenout relief valve responsive to receipt of a relief valve manual close input. As yet another illustrative, non-exclusive example, the closing at 170 may include automatically closing the remotely actuated screenout relief valve, such as responsive to the determining at 165, as discussed herein.

The closing at 170 further may include supplying, at 175, a close control signal to the remotely actuated screenout relief valve. Under these conditions, the closing at 170 may include closing responsive to receipt of the close control signal by the remotely actuated screenout relief valve. Illustrative, non-exclusive examples of the close control signal include an electric close control signal, an acoustic close control signal, a hydraulic close control signal, a wireless close control signal, and/or an electromagnetic close control signal.

When methods 100 include the supplying at 175, methods 100 further may include generating the close control signal and conveying the close control signal to the remotely actuated screenout relief valve. As an illustrative, non-exclusive example, the generating may include generating the close control signal at, near, and/or within the surface region. As another illustrative, non-exclusive example, the generating may include generating the close control signal within the casing conduit. As yet another illustrative, non-exclusive example, the hydrocarbon well may include the wireless communication network that includes the plurality of nodes, and the conveying may include conveying the close control signal with, or via, the plurality of nodes.

Resuming the providing the proppant slurry stream at 180 may include flowing the proppant slurry stream into the casing conduit. The resuming at 180 further may include flowing the proppant slurry stream from the casing conduit into the subterranean formation via the perforation that was created during the perforating at 160. Providing the ball sealer to the casing conduit at 185 may include providing any suitable ball sealer to the casing conduit to limit, block, occlude, and/or restrict fluid flow through the perforation.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of responding to a screenout event within a hydrocarbon well, the method comprising:

providing a proppant slurry stream containing a proppant to a casing conduit that is defined by a casing string that extends within a subterranean formation;

detecting an operational parameter that is indicative of a screenout event within the casing string;

responsive to the detecting the operational parameter that is indicative of the screenout event:

providing a flush fluid stream to the casing conduit;

providing a cross-linking gel stream to the casing conduit;

repeating the providing the flush fluid stream to the casing conduit to displace the cross-linking gel stream from the casing conduit and into the subterranean formation;

opening a remotely actuated screenout relief valve; and displacing proppant from the casing conduit into the subterranean formation with the flush fluid stream via the remotely actuated screenout relief valve; and closing the remotely actuated screenout relief valve.

2. The method of claim 1, wherein the detecting the operational parameter that is indicative of the screenout event includes at least one of detecting a wellbore pressure that is greater than a threshold screenout pressure, and detecting a wellbore pressure differential that is greater than a threshold wellbore screenout pressure differential, wherein the wellbore pressure differential is a difference between a first pressure, which is detected uphole from the screenout event, and a second pressure, which is detected downhole from the screenout event.

3. The method of claim 1, wherein the detecting the operational parameter that is indicative of the screenout event includes detecting a density of the proppant slurry stream within the casing conduit that is greater than a threshold screenout density.

4. The method of claim 1, wherein the opening the remotely actuated screenout relief valve includes supplying an open control signal to the remotely actuated screenout relief valve and opening the remotely actuated screenout relief valve responsive to receipt of the open control signal, wherein the open control signal includes at least one of an electrical open control signal, an acoustic open control signal, a hydraulic open control signal, a wireless open control signal, and an electromagnetic open control signal.

5. The method of claim 4, wherein the supplying the open control signal includes at least one of (i) generating the open control signal within a surface region and conveying the open control signal to the remotely actuated screenout relief valve, and (ii) generating the open control signal within the casing conduit and conveying the open control signal to the remotely actuated screenout relief valve;

wherein the hydrocarbon well includes a wireless communication network that includes a plurality of nodes, and further wherein the conveying the open control signal includes conveying the open control signal via the plurality of nodes.

6. The method of claim 1, wherein the closing the remotely actuated screenout relief valve includes supplying a close control signal to the remotely actuated screenout relief valve and closing the remotely actuated screenout relief valve responsive to receipt of the close control signal, wherein the close control signal includes at least one of an electrical close control signal, an acoustic close control signal, a hydraulic close control signal, a wireless close control signal, and an electromagnetic close control signal.

7. The method of claim 6, wherein the supplying the close control signal includes at least one of (i) generating the close control signal within a surface region and conveying the close control signal to the remotely actuated screenout relief valve, and (ii) generating the close control signal within the casing conduit and conveying the close control signal to the remotely actuated screenout relief valve;

wherein the hydrocarbon well includes a wireless communication network that includes a plurality of nodes, and further wherein the conveying the close control signal includes conveying the close control signal via the plurality of nodes.

8. The method of claim 1, wherein the method further includes flowing a perforation device into the casing conduit with the flush fluid stream and perforating the casing string with the perforation device to generate a perforation.

9. The method of claim 1, wherein the hydrocarbon well includes a plurality of remotely actuated screenout relief valves, and further wherein the opening the remotely actuated screenout relief valve includes opening a respective one of the plurality of remotely actuated screenout relief valves.

10. A system for responding to a screenout event, the system comprising:

a wellbore that extends within a subterranean formation;

a casing string that extends within the wellbore and defines a casing conduit;

a proppant supply system that is configured to provide a proppant slurry stream containing a proppant to the casing conduit;

a remotely actuated screenout relief valve that is configured to selectively transition between an open configuration, in which the valve permits fluid communication between the casing conduit and the subterranean formation, and a closed configuration, in which the valve restricts fluid communication between the casing conduit and the subterranean formation;

a detector that is configured to detect an operational parameter that is indicative of a screenout event; and a controller that is programmed to control the operation of the remotely actuated screenout relief valve using the method of claim 1.

11. A method of responding to a screenout event within a hydrocarbon well, the method comprising:

providing a proppant slurry stream containing a proppant to a casing conduit that is defined by a casing string that extends within a subterranean formation;

detecting an operational parameter that is indicative of a screenout event within the casing string;

determining a location of the screenout event;

responsive to the detecting the operational parameter that is indicative of the screenout event:

selecting one of a plurality of remotely actuated screenout relief valves based, at least in part, on the location of the screenout event, and further wherein the selecting includes selecting such that said one of the plurality of remotely actuated screenout relief valves is downhole from the screenout event;

providing a flush fluid stream to the casing conduit;

opening said one of the plurality of remotely actuated screenout relief valves;

displacing proppant from the casing conduit into the subterranean formation with the flush fluid stream via said one of the plurality of remotely actuated screenout relief valves; and closing said one of the plurality of remotely actuated screenout relief valves.

12. The method of claim 11, wherein the detecting the operational parameter that is indicative of the screenout event includes at least one of detecting a wellbore pressure that is greater than a threshold screenout pressure, and detecting a wellbore pressure differential that is greater than a threshold wellbore screenout pressure differential, wherein the wellbore pressure differential is a difference between a first pressure, which is detected uphole from the screenout event, and a second pressure, which is detected downhole from the screenout event.

13. The method of claim 11, wherein the detecting the operational parameter that is indicative of the screenout event includes detecting a density of the proppant slurry stream within the casing conduit that is greater than a threshold screenout density.

14. The method of claim 11, wherein the opening of said one of the plurality of remotely actuated screenout relief valves includes supplying an open control signal to said one of the plurality of remotely actuated screenout relief valves and opening said one of the plurality of remotely actuated screenout relief valves responsive to receipt of the open control signal, wherein the open control signal includes at least one of an electrical open control signal, an acoustic open control signal, a hydraulic open control signal, a wireless open control signal, and an electromagnetic open control signal.

15. The method of claim 14, wherein the supplying the open control signal includes at least one of (i) generating the open control signal within a surface region and conveying the open control signal to said one of the plurality of remotely actuated screenout relief valves, and (ii) generating the open control signal within the casing conduit and conveying the open control signal to said one of the plurality of remotely actuated screenout relief valves;

wherein the hydrocarbon well includes a wireless communication network that includes a plurality of nodes, and further wherein the conveying the open control signal includes conveying the open control signal via the plurality of nodes.

16. The method of claim 11, wherein the closing of said one of the plurality of remotely actuated screenout relief valves includes supplying a close control signal to said one of the plurality of remotely actuated screenout relief valves, and closing said one of the plurality of remotely actuated screenout relief valves responsive to receipt of the close control signal, wherein the close control signal includes at least one of an electrical close control signal, an acoustic close control signal, a hydraulic close control signal, a wireless close control signal, and an electromagnetic close control signal.

17. The method of claim 16, wherein the supplying the close control signal includes at least one of (i) generating the close control signal within a surface region and conveying the close control signal to said one of the plurality of remotely actuated screenout relief valves, and (ii) generating the close control signal within the casing conduit and conveying the close control signal to said one of the plurality of remotely actuated screenout relief valves;

wherein the hydrocarbon well includes a wireless communication network that includes a plurality of nodes, and further wherein the conveying the close control signal includes conveying the close control signal via the plurality of nodes.

18. The method of claim 11, wherein the method further includes flowing a perforation device into the casing conduit with the flush fluid stream and perforating the casing string with the perforation device to generate a perforation.

19. The method of claim 11, further comprising:

providing a cross-linking gel stream to the casing conduit; and repeating the providing the flush fluid stream to the casing conduit to displace the cross-linking gel stream from the casing conduit and into the subterranean formation.

20. A system for responding to a screenout event, the system comprising:

a wellbore that extends within a subterranean formation;

a casing string that extends within the wellbore and defines a casing conduit;

a proppant supply system that is configured to provide a proppant slurry stream containing a proppant to the casing conduit;

a remotely actuated screenout relief valve that is configured to selectively transition between an open configuration, in which the valve permits fluid communication between the casing conduit and the subterranean formation, and a closed configuration, in which the valve restricts fluid communication between the casing conduit and the subterranean formation;

a detector that is configured to detect an operational parameter that is indicative of a screenout event; and a controller that is programmed to control the operation of the remotely actuated screenout relief valve using the method of claim 11.

* * * * *